United States Patent [19]

Seller

[11] 4,428,034

[45] Jan. 24, 1984

[54] LIGHT BULB MOUNTING UNIT

[75] Inventor: Anthony J. Seller, Feckenham, England

[73] Assignee: Tildawn Electronics Ltd., England

[21] Appl. No.: 449,723

[22] Filed: Dec. 14, 1982

[30] Foreign Application Priority Data

Dec. 17, 1981 [GB] United Kingdom ..... 8138149

[51] Int. Cl.[3] ..... F21V 7/00

[52] U.S. Cl. ..... 362/186; 362/205; 362/295; 200/60

[58] Field of Search ..... 362/186, 205; 200/60; 362/295

[56] References Cited

U.S. PATENT DOCUMENTS

| | | | |
|---|---|---|---|
| 3,274,382 | 9/1966 | Fattori | 362/205 |
| 3,497,865 | 2/1970 | Heath | 362/457 |
| 4,286,310 | 8/1981 | Brainkel et al. | 362/205 |

*Primary Examiner*—Stephen J. Lechert, Jr.
*Attorney, Agent, or Firm*—C. O. Marshall, Jr.

[57] ABSTRACT

A lamp comprises a battery housing (60), a lens body (70) rotatably connected to the housing (60) and a bulb holder unit (10) which is rotatably fast with the lens body (70) in the assembled lamp. The bulb holder unit (10) is produced as a plastics moulding and is provided with terminals (38,58) which are so arranged with respect to the battery terminals (62, 64) that the lamp can be switched on and off by rotation of the lens body (70).

7 Claims, 7 Drawing Figures

LIGHT BULB MOUNTING UNIT

This invention relates to a light bulb mounting unit for use in lamps and like light sources. The invention also relates to a lamp assembly incorporating such a bulb mounting unit.

In conventional light bulb mountings, the bulb is located (by means of a screwthreaded fit or as a bayonet connection for example) in a holder formed as a metal component separate from the remainder of the mounting unit which may be a plastics moulding.

One object of the present invention is to provide a simplified form of light bulb mounting which is economical to manufacture.

According to the present invention we provide a light bulb mounting comprising a main body adapted to be fitted to the housing of a lamp or the like and a bulb holder for locating a light bulb in contact with electrical conductors for use in supplying electrical current to the bulb, characterised in that the bulb holder is in the form of a sleeve which restrains the bulb against tilting and the main body and the bulb holder are united integrally with one another as a single plastics moulding.

Preferably the sleeve is spaced from one face of the main body by a stem and an electrical terminal forming one of said conductors is located between the main body and the sleeve for engagement by the bulb, the terminal conveniently extending in cantilever fashion and being made of springy metal so that, when the bulb is correctly located in the sleeve, the terminal is resiliently deflected by engagement with the bulb thereby ensuring good electrical contact and positive positioning of the bulb.

The second electrical conductor is advantageously in the form of a wire or strip which is inserted through the bulb holder sleeve so that when the bulb is inserted the wire or strip is clamped between the bulb and the sleeve. Conveniently the wire or strip is anchored to the sleeve, e.g. by bending the wire or strip over that end of the sleeve which is remote from the main body.

The bulb holder sleeve is preferably adapted to provide a bayonet connection with the bulb and for this purpose the sleeve may be formed with diametrically opposite internal grooves to accommodate radially projecting pins on the bulb when the latter is being inserted in the sleeve. If desired, one such groove may be formed by a split in the sleeve wall with the added advantage of allowing the sleeve to be expanded resiliently by insertion of the bulb so that the sleeve grips the bulb. In addition, with such an arrangement bulb insertion is not impeded by the presence of the wire or strip inside the sleeve since the sleeve can expand radially. This avoids the need to insert the wire or strip into the wall of the sleeve.

Although it is preferred to provide a bayonet type connection between the bulb and the sleeve, conceivably the sleeve could be moulded with an internal thread for engagement with a corresponding male thread on the bulb.

One example of the invention is shown in the accompanying drawings to which reference is now made. In the drawings.

Figure 1:
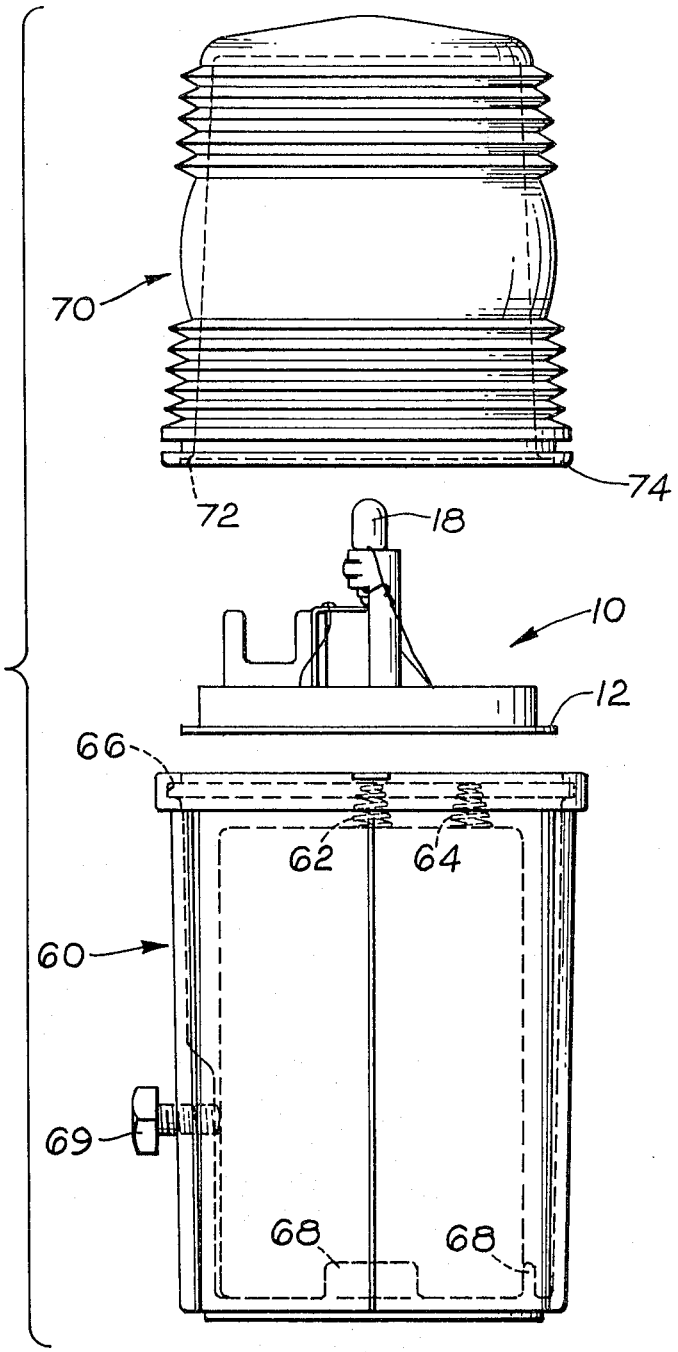
FIG. 1 is an exploded view of a lamp assembly.

Referring firstly to FIGS. 4–7, the bulb mounting unit shown comprises a main disc shaped body 10 having a peripheral flange 12 by means of which the mounting unit can be fitted to a lamp with the flange 12 seated against a shoulder 72 on a lens body 70. A stem 14 projects from the main body 10 and terminates in a laterally projecting bulb holder sleeve 16 which, in the illustrated embodiment, is adapted to provide a bayonet connection with a bulb 18 of the type provided with radial pins 20. The main body 10, the stem 14 and the sleeve 16 are all integrally united with one another by forming the unit as a single moulding.

The sleeve 16 defines a through-bore 22 flanked by a pair of diametrally-opposed grooves 24, 26 (see FIG. 6) which run the entire length of the sleeve and terminate at a shoulder formed by the bottom edge 30 of the sleeve.

The internal diameter of the sleeve 16 is substantially the same as the cylindrical outer terminal 34 of the bulb and the bulb is inserted by aligning its pins 20 with the grooves 24, 26, displacing it downwardly until the pins 20 clear the bottom edge 30 of the sleeve and then twisting the bulb so that the pins engage beneath the bottom edge 30 thereby trapping the bulb.

The electrical connection for connecting the outer terminal 34 of the bulb to the battery is provided by a wire 36 which is threaded through the sleeve 16, the lower end of the wire 36 being connected via circuitry 90 to a central terminal 38. The terminal 38 is secured to the main body so that it can contact a central battery terminal 62 on the other side of the main body to the bulb. Thus the main body is moulded with apertures 40, 42 through which ends of the terminal 38 are passed and bent to secure it in place leaving the central portion of the terminal 38 at the underside of the main body.

The centre terminal 44 of the bulb is connected to the battery by way of a springy metal terminal 46 having a bent portion 48 which extends in cantilever fashion below the lower open end of the sleeve 16 so that the bulb terminal 44 presses against the portion 48 when it has been fully inserted. The main body includes an upwardly projecting wall 50 over which the portion 48 is bent to provide the cantilever support. The terminal 46 also passes through apertures 54, 56 in the main body so that a portion 58 is located at the other side of the body 10 in radially offset relation to the terminal 38 for cooperation with a second radially offset battery terminal 64.

The arrangement of the bent portion 48 is such that it is contacted by the central bulb terminal 44 before the bulb has been fully inserted so that it resiliently opposes further insertion of the bulb. In this way, the portion 48 is resiliently stressed when the bulb has been fully inserted and serves to press the pins 20 against the bottom edge 30 of the sleeve 16. In a modification, the sleeve 16 may be moulded with a slit 80 (see FIG. 7) so that it is thereby divided into two halves which may be arranged so as to grip the bulb with a resilient action.

From the foregoing, it will be seen that a mounting is provided in which the bulb is located by a plastics bulb holder which is formed integrally with the remainder of the unit. The bulb is held securely by the sleeve and is restrained against tilting. Moreover, the electrical connections are of relatively simple design and separate springs for urging the electrical connections into contact with the bulb terminal are not required.

Figure 2:
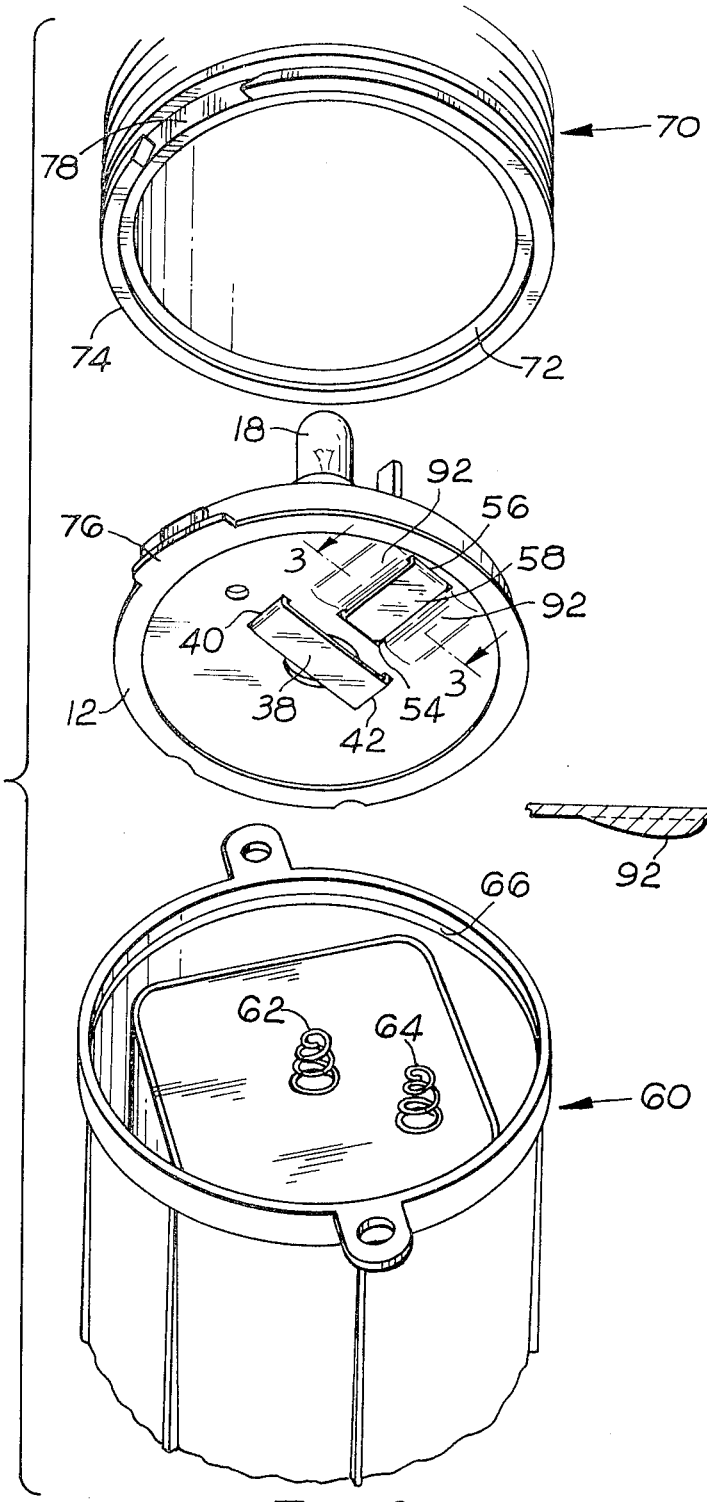
FIG. 2 is a perspective view corresponding to FIG. 1.
Figure 3:
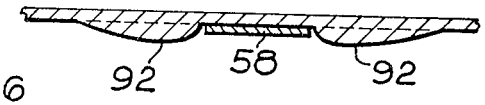
FIG. 3 is a section on 3—3 in FIG. 2.
Figure 4:
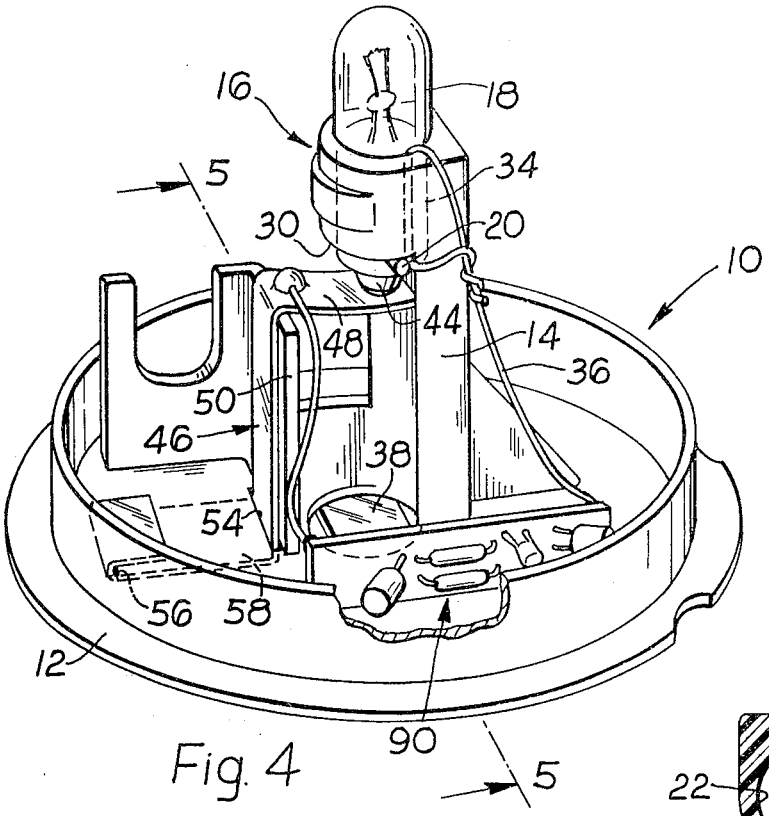
FIG. 4 is a perspective view of the bulb mounting unit.
Figure 6:
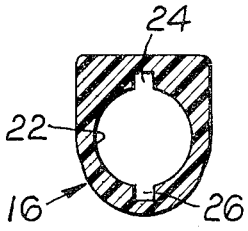
FIG. 6 is a cross-section taken in the direction 6—6 in FIG. 5.
Figure 5:
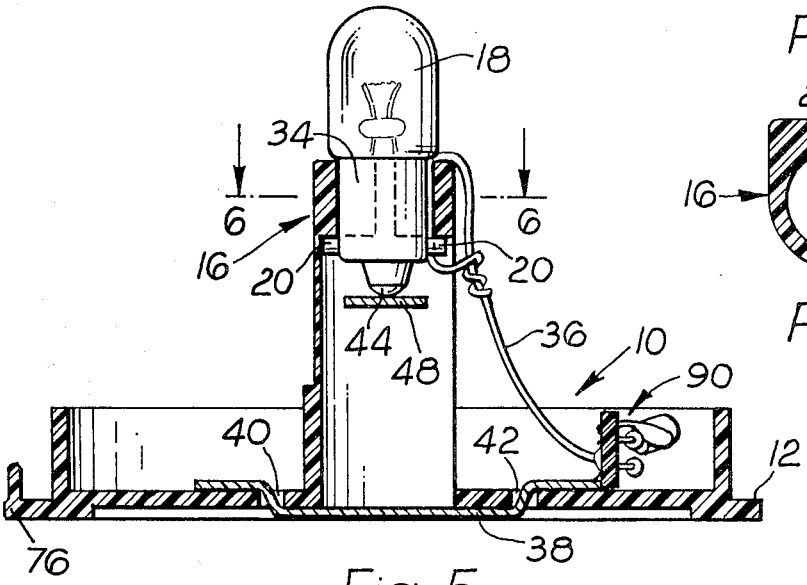
FIG. 5 is a diametral section taken in the direction 5—5 in FIG. 4.
Figure 7:
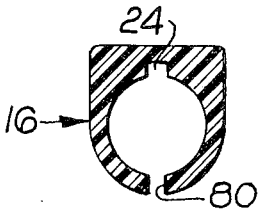
FIG. 7 is a cross-section similar to FIG. 6 but illustrating a modification.

Referring now to FIGS. 1 to 3, the mounting unit 10 is intended to be assembled with the battery housing 60 and the lens body 70 so that the stem 14 of the unit locates the bulb at the focal centre of the lens body 70. The housing 60 includes a groove 66 around its mouth for snap-fit reception of an annular tongue 74 of the lens body so that the lens body can be rotated with respect to the housing. In use, the main body 10 is trapped between the battery terminals 62, 64 and the shoulder 72 and is rendered rotatably fast with the lens body by means of a key 76 engaging in a recess 78 of the lens body. When so assembled, the battery terminal 62 bears against the terminal portion 38 and the battery terminal 64 is located along the path of travel of the terminal portion 58 during rotation of the lens body and bulb holder. The battery is prevented from any tendency to rotate by projections 68 integral with the housing 60, and grubscrew 69.

From the foregoing, it will be seen that the lamp may be switched on by rotating the lens body until the terminal portion 58 engages battery terminal 64. Switch-off is effected by turning the lens body until portion 58 disengages from the battery terminal 64. The underside of the main body 10 may be provided with shallow projections 92 for co-operation with battery terminal 64 to resist accidental switch-off or switch-on. Where the lamp is required to provide a "winking" action, its electrical circuit conveniently includes circuitry 90 for automatically interrupting the circuit at a preselected frequency, e.g. 60–120 Hz.

I claim:

1. A lamp comprising a housing for reception of a battery, and a lens body mounted on the housing for rotation relative thereto, wherein the improvement comprises a bulb holder unit comprising a main body which is rotatably fast with the lens body, a bulb-holding sleeve which is open at both ends and is integrally united with the main body as a single plastics molding, a first contact mounted opposite to one end of said sleeve in position to be engaged by the base of a bulb inserted in the other end of said sleeve, and a second contact extending within the side of said sleeve, said main body having a base provided with two bottom terminals one of which is central, the other of which is offset and each of which is connected to a different one of said contacts, said terminals being arranged to cooperate with central and offset terminals of a battery in said housing, to permit the lamp to be switched on and off by rotation of the lens body relative to the battery housing.

2. A lamp as claimed in claim 1 in which said first contact is resilient and extends in cantilever fashion in position to be engaged and resiliently deflected by the base of a bulb inserted in the sleeve.

3. In a bulb holder unit for incorporation in a lamp, a main body, a bulb-holding sleeve which is open at both ends and is integrally united with the main body as a single plastics molding, a first contact mounted opposite to one end of said sleeve in position to be engaged by the base of a bulb inserted in the other end of said sleeve, and a second contact extending within the side of said sleeve, said main body having a base provided with two bottom terminals one of which is central, the other of which is offset and each of which is connected to a different one of said contacts, said terminals being arranged to cooperate with central and offset terminals of a battery in said lamp.

4. In a bulb holder unit as claimed in claim 3, a stem integral with said main body and said sleeve which spaces the sleeve from the main body.

5. In a bulb holder unit as claimed in claim 3, a first contact which is resilient and extends in cantilever fashion in position to be engaged and resiliently deflected by the base of a bulb inserted in the sleeve.

6. In a bulb holder unit as claimed in claim 3, a second contact extending through the sleeve which is clamped between the bulb and the sleeve.

7. In a bulb holder unit as claimed in claim 3, slots in the sleeve which provide a bayonet connection with the bulb.

* * * * *